US011162251B2

(12) United States Patent
Beck et al.

(10) Patent No.: US 11,162,251 B2
(45) Date of Patent: Nov. 2, 2021

(54) BATHTUB DRAIN STOPPER

(71) Applicant: PF Waterworks LP, Houston, TX (US)

(72) Inventors: Harold Kent Beck, Copper Canyon, TX (US); Sanjay Ahuja, Katy, TX (US)

(73) Assignee: PF Waterworks LP, Houston, TX (US)

( * ) Notice: Subject to any disclaimer, the term of this patent is extended or adjusted under 35 U.S.C. 154(b) by 0 days.

(21) Appl. No.: 15/584,032

(22) Filed: May 2, 2017

(65) Prior Publication Data

US 2017/0314245 A1 Nov. 2, 2017

Related U.S. Application Data

(60) Provisional application No. 62/330,783, filed on May 2, 2016, provisional application No. 62/460,071, filed on Feb. 16, 2017.

(51) Int. Cl.

| | |
|---|---|
| ***E03C 1/23*** | (2006.01) |
| ***E03C 1/26*** | (2006.01) |
| ***E03C 1/262*** | (2006.01) |

(52) U.S. Cl.

CPC ..... *E03C 1/2306* (2013.01); *E03C 1/262* (2013.01)

(58) Field of Classification Search

CPC ..... E03C 1/2306; E03C 1/262; E03C 1/26; E03C 1/264; A47K 1/14

USPC ..... 4/286–295

See application file for complete search history.

(56) References Cited

U.S. PATENT DOCUMENTS

| | | | | |
|---|---|---|---|---|
| 1,388,327 | A * | 8/1921 | Cornelius | E03C 1/22 4/693 |
| 3,366,980 | A * | 2/1968 | Forgie | A47K 1/14 338/22 R |
| 3,428,295 | A * | 2/1969 | Jones | F16K 31/528 251/263 |
| 4,007,500 | A | 2/1977 | Thompson et al. | |
| 4,381,569 | A * | 5/1983 | Ingram | A47K 1/14 138/89 |
| 4,597,112 | A * | 7/1986 | Cuschera | A47K 1/14 4/287 |
| 6,490,739 | B1 * | 12/2002 | Lee | A47K 1/14 4/293 |
| 8,590,065 | B2 * | 11/2013 | Ali | A47K 1/14 4/287 |
| 2010/0024108 | A1 * | 2/2010 | Yang | E03C 1/23 4/295 |
| 2011/0138527 | A1 * | 6/2011 | Siena | A47K 1/14 4/295 |
| 2012/0036624 | A1 * | 2/2012 | Laera | A47K 1/14 4/295 |
| 2013/0042398 | A1 | 2/2013 | McLeod | |
| 2013/0125299 | A1 * | 5/2013 | Tong | A47K 1/14 4/295 |

(Continued)

*Primary Examiner* — Janie M Loeppke

(74) *Attorney, Agent, or Firm* — Stephen S. Hodgson

(57) ABSTRACT

A bathtub drain stopper includes an open-close mechanism having threaded upper and lower ends, a cap, a seal, and means for anchoring the open-close mechanism in a drain pipe, where the length can be adjusted and fixed with a lock nut. A threaded anchor is provided for a tub shoe having a crossbar with a threaded opening. An anchor having prongs is provided for a tub shoe having a crossbar with no opening. A wheel-shaped anchor having an O-ring about its perimeter is provided for a drain that does not have a crossbar.

24 Claims, 2 Drawing Sheets

(56) References Cited

U.S. PATENT DOCUMENTS

| | | | | |
|---|---|---|---|---|
| 2013/0180045 | A1* | 7/2013 | Ball | E03C 1/24 4/680 |
| 2013/0269100 | A1* | 10/2013 | Ball | E03C 1/23 4/693 |
| 2016/0130793 | A1 | 5/2016 | Lesmeister | |

* cited by examiner

BATHTUB DRAIN STOPPER

CROSS REFERENCE TO RELATED APPLICATIONS

This application claims priority to and the benefit of U.S. Provisional Patent Application Ser. Nos. 62/330,783, filed May 2, 2016, and 62/460,071, filed Feb. 16, 2017, each of which is incorporated by reference. U.S. patent application Ser. No. 15/584,030, now U.S. Pat. No. 10,301,803, is a related application.

BACKGROUND OF THE INVENTION

1. Field of the Invention

This present invention pertains to a drain assembly used to retain fluid in and release fluid from a bathtub and more particularly to a drain stopper for a bathtub.

2. Description of the Related Art

There are a number of types of drain systems or assemblies for retaining water in and then draining water from a bathtub. A drain pipe is sealed in a drain opening using a drain flange that is sealed to the bathtub around the opening. A drain pipe for a bathtub typically has a 90-degree bend, which gives the drain pipe the appearance of a shoe, so a drain pipe for a bathtub is often referred to as a tub shoe. The drain pipe will often, but not always, have a member inside called a crossbar. A crossbar is generally a set of two bars crossed, which divide the drain opening into four pie-shaped openings. One type of crossbar has a threaded opening in the center and another does not. U.S. Pat. No. 3,428,295, issued to Downey et al., describes a push-actuated drain valve, which is anchored to a crossbar that has a threaded opening. U.S. Pat. No. 4,007,500, issued to Thompson et al., describes a different push-type drain stopper for a bathtub, which is also anchored by a bolt threaded into a central threaded opening in a bathtub drain crossbar.

SUMMARY OF THE INVENTION

A drain stopper for a bathtub having a drain opening and a drain pipe having a drain flange attached to the bathtub at the drain opening is described, which includes: an open-close mechanism having upper and lower ends, wherein the open-close mechanism is a lift-and-lock mechanism or a lift-and-turn mechanism, wherein the upper and lower ends have threads, and wherein the upper end has male threads; a cap having a bore with female threads, wherein the upper end of the push mechanism is received in the bore of the cap in a threaded engagement; a seal engaged with the cap for providing a seal with the drain flange or the drain pipe; means for anchoring the open-close mechanism in the drain pipe, wherein the lower end of the push mechanism is in threaded engagement with the means for anchoring, wherein the drain stopper has a length between the cap and the means for anchoring, and wherein the length can be adjusted by the amount that the upper end of the push mechanism is screwed into the bore in the cap; and a lock nut having female threads received on and in threaded engagement with the upper end of the push mechanism, wherein the lock nut is in a tight friction abutment with the cap for holding the length of the drain stopper constant.

The means for anchoring the open-close mechanism in the drain pipe is preferably selected from the group consisting of: male threads on the lower end of the push mechanism for threading into a tub shoe that has cross bars with an opening defined by female threads; an anchor comprising a base and a set of prongs, wherein the base is in threaded engagement with the lower end of the open-close mechanism, and wherein the prongs have a catch mechanism for engaging a tub shoe that has cross bars without a threaded opening; and a wheel-shaped circular body having a groove along its perimeter and an O-ring received in the groove, wherein the body has openings for allowing water to pass through the body, and wherein the body and the O-ring are designed and sized for a friction engagement in a drain pipe that does not have a crossbar. In one embodiment, the cap has a diameter at its widest point, wherein the seal has a diameter at its widest point, and wherein the diameter of the cap is 10 to 50 percent, preferably 20 to 40 percent, greater than the diameter of the seal. In another embodiment, a strainer basket surrounds the push mechanism.

BRIEF DESCRIPTION OF THE DRAWINGS

A better understanding of the invention can be obtained when the detailed description of exemplary embodiments set forth below is considered in conjunction with the attached drawings in which.

DETAILED DESCRIPTION OF THE EXEMPLARY EMBODIMENTS

Figure 2:
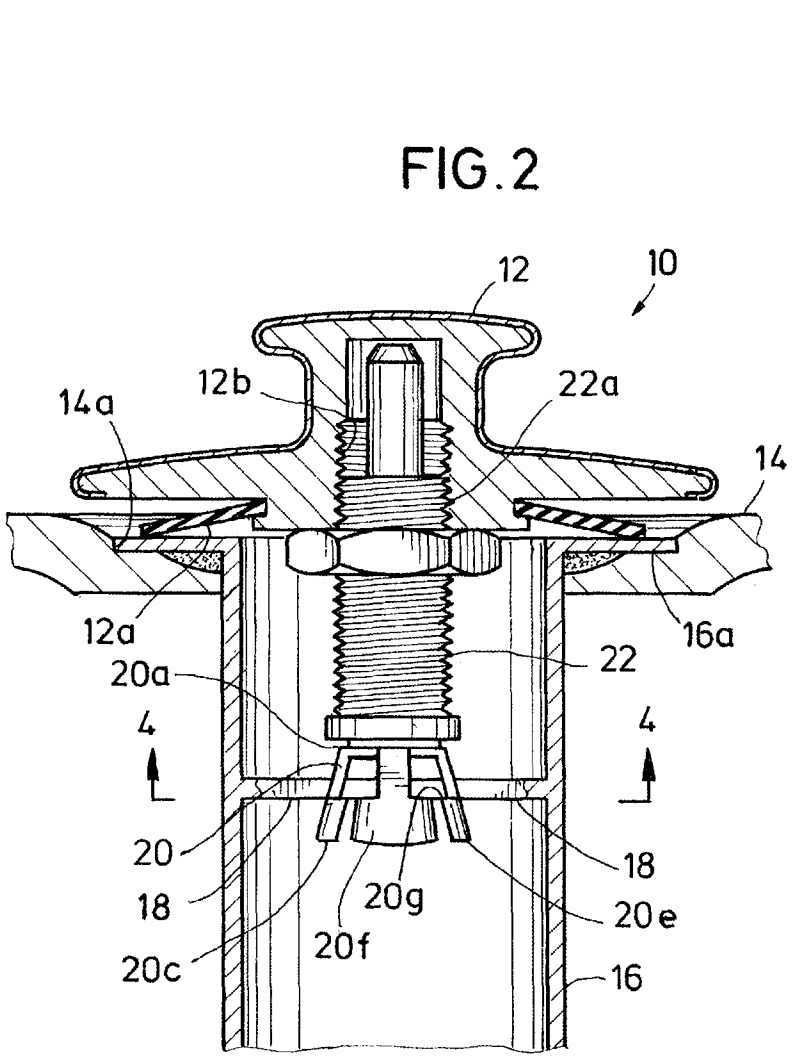
FIG. 2 is a side elevation in partial cross-section of the bathtub drain stopper of FIG. 1 in a closed position.
Figure 1:
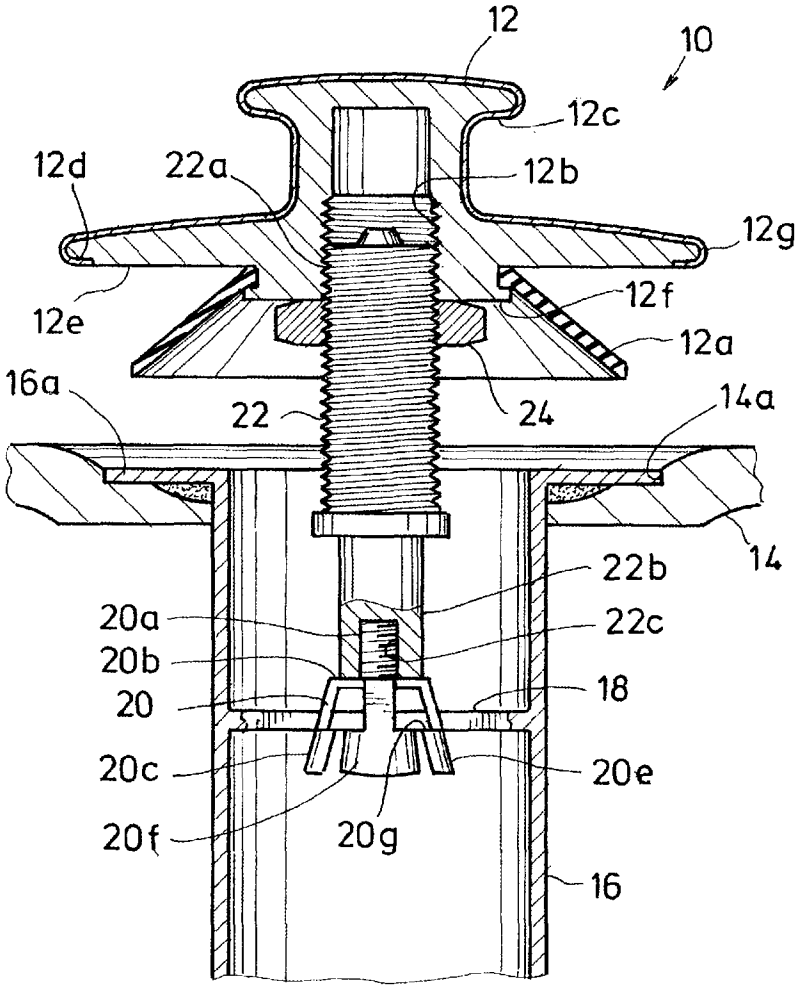
FIG. 1 is a side elevation in partial cross-section of a bathtub drain stopper in an open position, according to the present invention.
Figure 4:
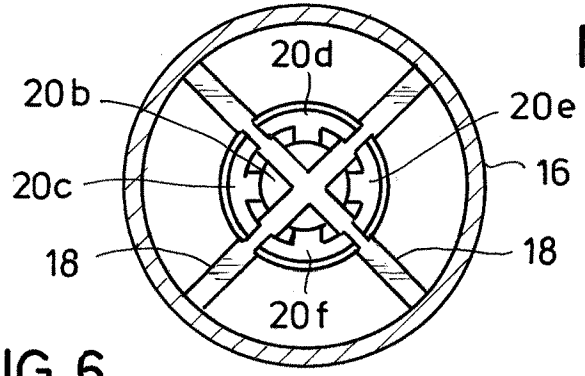
FIG. 4 is a plan view of the bathtub drain stopper of FIG. 2 as seen along the line 4-4.

FIG. 1 is a side elevation in partial cross-section of a push-type bathtub drain stopper 10 in an open position. FIG. 2 shows the drain stopper 10 in a closed position. Stopper 10 has a cap 12 and a gasket or seal 12*a*. A bathtub or a sink 14 has a drain opening 14*a*. A drain pipe 16 has a drain flange 16*a* sealed against the tub 14 at the drain opening 14*a*. FIG. 4 is a cross-section of the drain pipe 16 as seen along the line 4-4 in FIG. 2. FIG. 4 shows a plan view of a crossbar 18. Crossbar 18 does not have a threaded opening. Crossbar 18 is a set of two crossed bars. An anchor 20 is used to fasten drain stopper 10 to crossbar 18. Anchor 20 has a threaded stud 20*a* that projects upwardly toward the main body of drain stopper 10 from a base plate 20*b*. Anchor 20 has four prongs 20*c*, 20*d*, 20*e* and 20*f* that project downwardly from the base plate 20*b*. Each of the prongs has the shape of a garden spade, where a handle or shaft portion connects to the base plate 20*b* and terminates in a flat and generally rectangular head at a distal end. A shoulder 20*g* is defined where the narrow shaft portion transitions into the wide head portion. The head portions of the prongs of anchor 20 pass through and slightly beyond the cross bar 18, and the shoulders 20*g* catch on the cross bars and anchor drain stopper 10 to the crossbar 18.

Drain stopper 10 has a push mechanism 22 such as described in U.S. Pat. Nos. 3,428,295 and 4,007,500. A push downward on the open stopper in FIG. 1 closes the stopper, and a downward push on the closed stopper in FIG. 2 causes the stopper to move into the open position. Push mechanism 22 has an upper end 22*a* and a lower end 22*b*. The lower end 22*b* has a central longitudinal bore 22*c* that is defined by female threads. The stud 20*a* of anchor 20 is threaded into the bore 22*c* of the push mechanism 22, which connects the push mechanism 22 to the crossbar 18. Drain stopper 10 can be used in different drain pipes, where the distance between the tub shoe and the top of the drain flange varies. Cap 12 has a central longitudinal bore 12*b* defined by female threads, and the push mechanism 22 has male threads at its upper end 22*a*. The upper end 22*a* of the push mechanism 22 is received in the bore 12*b* of the cap 12. The amount that the push mechanism 22 is threaded into the bore 12*b* provides a way for adjusting the push mechanism to fit different distances between the crossbar and the top of the drain flange. After the push mechanism 22 is threaded into the bore 12*b* a desired amount to accommodate a particular distance or height, a lock nut 24 is tightened against a bottom surface of the cap 12 to maintain the desired length between the cap 12 and the crossbar 18.

The cap 12 has a diameter that is greater than the diameter of the drain flange 16*a*. The purpose of this is to hide the drain flange 16*a* from view, possibly because the finish on the drain flange 16*a* has become damaged or worn and is unsightly or because one wishes to change the finish color, such as from polished brass to chrome. Cap 12 has a grip portion 12*c* and a decorative cover 12*d* that covers all of an upper surface of a body 12*e*. The body 12*e* may alternatively have a dome shape without the grip portion 12*c*. The body 12*e* has a cylinder 12*f* located centrally and projecting downwardly. The cylinder 12*f* has a circumferential groove, and the seal 12*a* is seated in the groove. The lock nut 24 tightens against the cylinder 12*f*. Cap 12 has a greatest diameter D at an outermost edge 12*g* where the decorative cover 12*d* begins to fold inwardly and wrap under a flanged portion of the body 12*e*. In order for the cap 12 to serve the purpose of covering the drain flange 16*a*, the diameter D of the cap 12 should be equal to or greater than the diameter of the drain flange 16*a*. In one instance the diameter of the drain flange 16*a* may be 2.75 inches, so the diameter D of the cap 12 should be 2.75 inches or greater, preferably 3.0 to 3.5 inches in diameter. The seal 12*a* should rest on and seal against the drain flange 16*a*. The diameter D of the cap 12 should be greater than the diameter of the seal 12*a* at its widest point in order for the decorative cover 12*d* to cover and hide the drain flange 16*a*. The diameter D of the cap 12 may be 10 to 50, preferably 20 to 40, percent greater than the diameter of the seal 12*a*. If the seal fits inside the drain pipe and seals against an inside wall of the drain pipe, then the diameter D may need to be 50 to 75 percent greater that the diameter of the seal. However, it is generally satisfactory to use a smaller cap of a standard size, which does not cover the drain flange.

Figure 7:
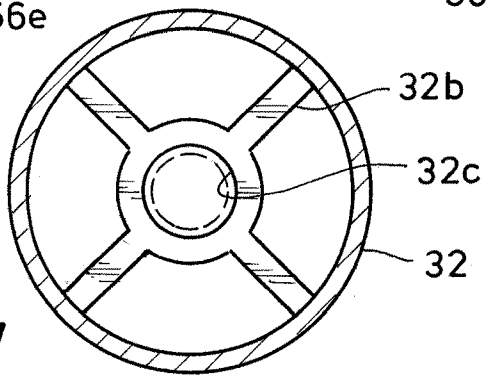
FIG. 7 is a plan view of the anchor system of FIG. 3 as seen along the line 7-7.
Figure 3:
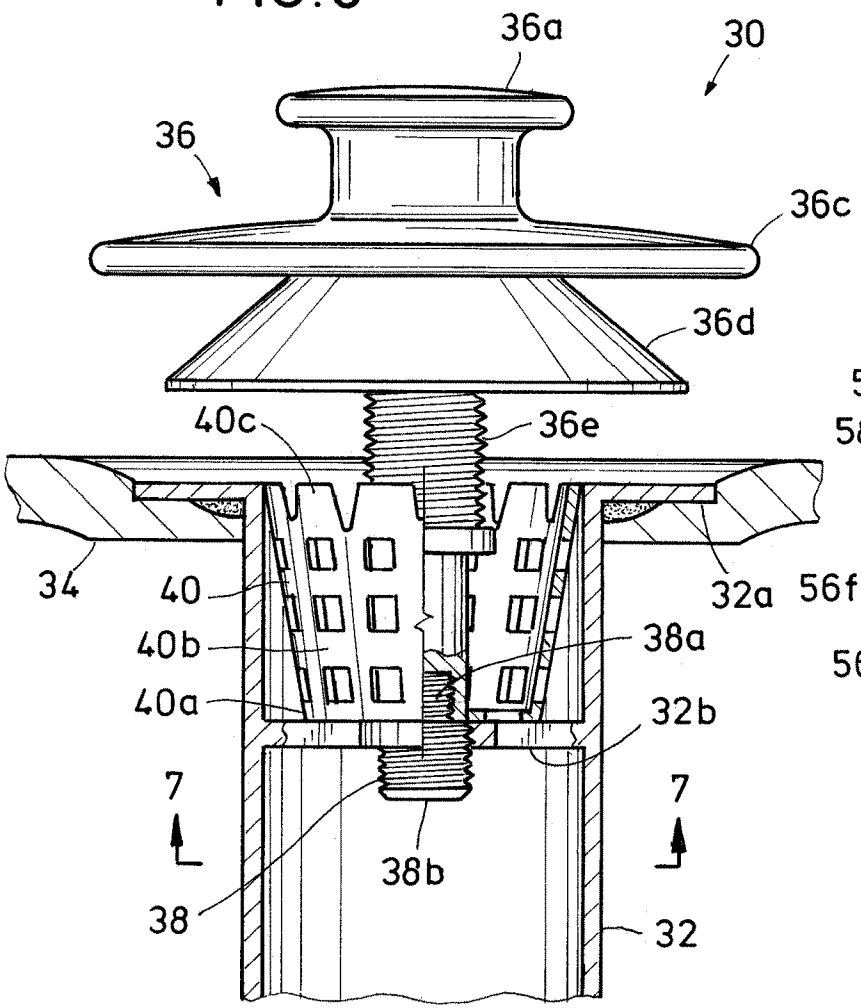
FIG. 3 is a side elevation in partial cross-section of a bathtub drain assembly, according to the present invention.

FIG. 3 is a side elevation in partial cross-section of a bathtub drain assembly 30, which is made and used as described with reference to FIGS. 1 and 2, except anchored differently to a different tub shoe and having a strainer. A drain pipe 32 has a drain flange 32*a* sealed about a drain opening in a bathtub 34. A crossbar 32*b* is fixed inside the drain pipe 32. FIG. 7 is a cross-section of the drain pipe 32 as seen along the line 7-7 in FIG. 3. The crossbar 32*b* has a central threaded opening 32*c*. A drain stopper 36 includes a cap 36*a*, which has a grip portion 36*b*, a large and decorative drain cover 36*c*, a seal 36*d*, which seals against the drain flange 32*a*, a push mechanism 36*e* and a lock nut 36*f* as shown in FIG. 1, but not visible in FIG. 3. The push mechanism 36*e* has the same male threads on an upper end and is threaded into the cap for adjusting height in the same manner as described for the stopper 10 in FIG. 1. The push mechanism 36*e* also has the same threaded bore at its lower end as the bore 22*c* in FIG. 1. An anchor element 38 is a threaded rod that has an upper end 38*a* and a lower end 38*b*. The upper end 38*a* has male threads and is sized to screw into the threaded bore in the lower end of the push mechanism 36*e*. The lower end 38*b* of the anchor element 38 has male threads and is sized to thread into the threaded opening 32*c* of the crossbar 32*b*.

The anchor element 38 thus anchors the push mechanism 36*e* to the crossbar 32*b* in the drain pipe 32 because the upper end 38*a* is in threaded engagement with the push mechanism 36*e* and the lower end 38*b* is in threaded engagement with the crossbar 32*b*. The anchor element 38 can be made to have different diameters for its upper and lower ends for attachment to crossbars that have a threaded opening of different sizes and to accommodate a push mechanism that has a threaded bore of a different size. A kit can be assembled and sold that has a drain stopper with a push mechanism and several all-thread anchors, which each have an upper end that threads into a threaded bore in the push mechanism, but each has a different diameter for its lower end to fit into different tub shoes that have crossbars with threaded openings of different sizes. The four-prong anchor 20 of FIG. 1 can be included in the kit for attachment to a tub shoe that has a cross bar but no threaded opening.

A strainer basket 40 is received in the drain pipe 32 above the crossbar 32*b* and surrounds the push mechanism 36*e*. The strainer basket has a circular, annular, washer-shaped base 40*a* that has a central opening through which the push mechanism 36*e* passes. The base 40*a* rests on the crossbar 32*b*. Strainer 40 has a side wall 40*b* and an open upper end 40*c*. The open upper end 40*c* has a diameter that is greater than the diameter of the base 40*a*. Consequently, the side wall 40*b* of the strainer basket 40 flares outwardly from the base 40*a* to the upper end 40*c*, which gives the side wall 40*b* a conical shape. The upper end has V-shaped notches made in and pointing into the side wall 40*b*. The side wall 40*b* and the base 40*a* of the strainer 40 have a plurality of openings through which water can pass. A strainer basket can also be used with the drain stopper 10 in FIG. 1. Strainers typically have the shape of a basket, such as shown in FIG. 3. An alternative strainer is a perforated disc that has holes or slots, which is inserted into a drain pipe to catch hair or objects. A perforated-disc strainer can also function as a universal adapter that will work in drains that do not have a threaded connector with the addition of a restraining element.

Figure 5:
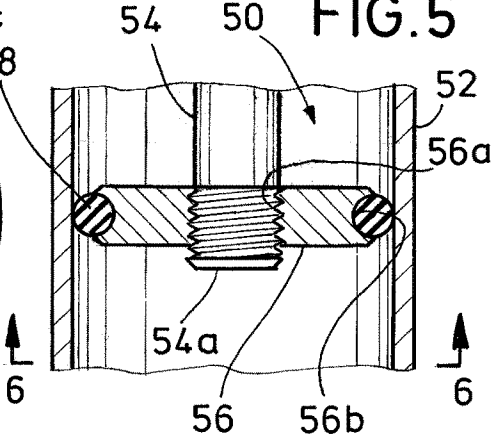
FIG. 5 is a side elevation in cross-section of an anchor system for a bathtub drain stopper, according to the present invention.
Figure 6:
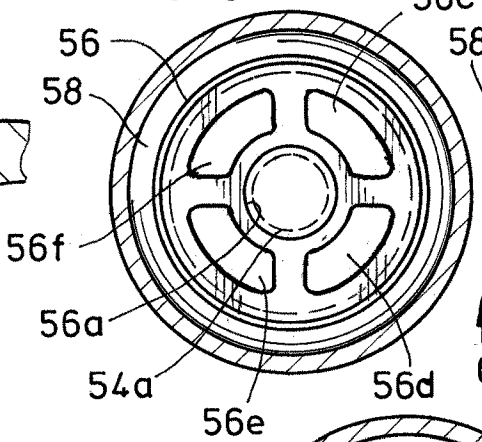
FIG. 6 is a plan view of the anchor system of FIG. 5 as seen along the line 6-6.

FIG. 5 is a side elevation in cross-section of an anchor system 50 for a drain pipe 52 that does not have a cross bar. A push mechanism 54 has a threaded lower end 54*a*. A disc 56 has a central threaded bore 56*a* and is threaded onto the lower end 54*a* of the push mechanism. FIG. 6 is a view of the disc 56 as seen along the line 6-6 in FIG. 5. Disc 56 has the shape of a wheel with a circumferential groove 56*b* along its outer perimeter. An O-ring 58 is received in the groove 56*b*. The disc 56 is pressed into the drain pipe 52, and the O-ring 58 provides friction against an inside wall of the drain pipe 52 for anchoring the disc 56 and the push mechanism 54 in the drain pipe 52. The drain pipe 52 has a longitudinal axis that is coaxial with the flow path of water draining through the drain pipe. The disc 56 is oriented transverse, perpendicular, to the longitudinal axis of the drain pipe 52. Disc 56 has openings 56*c*, 56*d*, 56*e* and 56*f* through which water can flow and drain.

Some drain stoppers for bathtubs are referred to as toe touch, lift and lock and lift and turn. The push mechanism described above is referred to as the toe touch since a push on the top of the stopper will change the position of the stopper from open to closed or from closed to open. The larger-than-normal drain cap for covering a drain flange can also be used with a lift and lock stopper and with a lift and turn stopper. The anchoring systems described above, namely the multiple-prong anchor, the all-thread rod having one diameter to fit the open-close mechanism and another diameter to fit an opening in a crossbar, and the wheel-shaped disc with an O-ring to seal against an inside wall of a drain pipe, can also be used with a lift and lock stopper and with a lift and turn stopper. The strainer basket can be used with any of the anchoring systems described above and also with a lift and lock stopper and with a lift and turn stopper, with or without a large drain-covering cap.

Having described the invention above, various modifications of the techniques, procedures, materials, and equipment will be apparent to those skilled in the art. It is intended that all such variations within the scope and spirit of the invention be included within the scope of the appended claims.

What is claimed is:

1. A drain stopper for a bathtub having a drain opening and a drain pipe having a drain flange attached to the bathtub at the drain opening, wherein the drain pipe may or may not have a crossbar for anchoring the drain stopper, wherein the crossbar may or may not have a threaded opening, and wherein the threaded opening may have one of more than one size, the drain stopper comprising:

a cap having a bore;

an open-close mechanism comprising a tubular element having a first bore and an elongate element received in the first bore and moveable between open and closed positions for the drain stopper, wherein the open-close mechanism has upper and lower ends, and wherein the upper end is received in the bore of the cap, wherein the lower end of the open-close mechanism has a second bore defined by female threads, wherein the second bore may or may not be part of the first bore, and wherein the lower end of the open-close mechanism has an outside surface and male threads on the outside surface, and wherein the male threads surround the second bore;

a lock nut engaged with the upper end of the open-close mechanism and pressed against the cap;

a seal engaged with the cap for providing a seal with the drain flange or the drain pipe; and means for anchoring the open-close mechanism in the drain pipe, wherein the means for anchoring is in a threaded engagement with the lower end of the open-close mechanism.

2. The drain stopper of claim 1, wherein the means for anchoring the open-close mechanism in the drain pipe is an anchor for attaching the open-close mechanism to a cross bar that does not have a threaded opening, wherein the anchor comprises a base and a set of prongs, wherein the base is in threaded engagement with the lower end of the open-close mechanism, and wherein the prongs have a catch mechanism for engaging the cross bars.

3. The drain stopper of claim 1, wherein the means for anchoring the open-close mechanism in the drain pipe is a stud on the base that is threadedly engaged with the female threads that define the second bore.

4. The drain stopper of claim 1, wherein the means for anchoring the open-close mechanism in the drain pipe is a rod having opposing ends and male threads, wherein one end of the rod is engaged with the female threads that define the second bore, and wherein the other end of the rod is sized to engage the threaded opening of a crossbar for anchoring the drain stopper in the drain pipe.

5. The drain stopper of claim 1, wherein the means for anchoring the open-close mechanism in the drain pipe is a body having a seal, wherein the body and the seal are designed and sized for a friction engagement in a drain pipe that does not have a crossbar for anchoring the drain stopper in the drain pipe, wherein the body is threadedly engaged with the lower end of the open-close mechanism, and wherein the body has openings for allowing water to pass through the body.

6. The drain stopper of claim 5, wherein the body has the shape of a wheel with a central threaded hole sized for a threaded engagement with the male threads on the lower end of the open-close mechanism.

7. The drain stopper of any one of claims 1-6, further comprising a strainer basket surrounding the open-close mechanism, wherein the strainer basket has a closed end with a central opening for receiving the open-close mechanism, an opposing open end and a side wall attached to the closed end that flares outwardly from the closed end, wherein the side wall has V-shaped notches adjacent to the open end, and wherein the sidewall and the closed end have openings for water to flow through.

8. The drain stopper of claim 1, wherein the diameter of the cap is greater than the diameter of the seal, further comprising a strainer basket surrounding the open-close mechanism, wherein the strainer basket has a closed end with a central opening for receiving the open-close mechanism, an opposing open end and a side wall attached to the closed end that flares outwardly from the closed end, and wherein the sidewall and the closed end have openings for water to flow through.

9. A drain stopper for a bathtub having a drain opening and a drain pipe having a drain flange attached to the bathtub at the drain opening, comprising:

an open-close mechanism having upper and lower ends, wherein the open-close mechanism is a push mechanism, a lift-and-lock mechanism or a lift-and-turn mechanism, wherein the upper end has male threads, wherein the lower end of the open-close mechanism has a bore defined by female threads, wherein the lower end of the open-close mechanism has an outside surface and male threads on the outside surface, and wherein the male threads surround the bore;

a cap having a bore with female threads, wherein the upper end of the open-close mechanism is received in the bore of the cap in a threaded engagement;

a seal engaged with the cap for providing a seal with the drain flange or the drain pipe;

means for anchoring the open-close mechanism in the drain pipe, wherein the lower end of the open-close mechanism is in threaded engagement with the means for anchoring, wherein the drain stopper has a length between the cap and the means for anchoring, and wherein the length can be adjusted by the amount that the upper end of the open-close mechanism is screwed into the bore in the cap; and a lock nut having female threads received on and in threaded engagement with the upper end of the open-close mechanism, and wherein the lock nut is in a tight friction abutment with the cap for holding the length of the drain stopper constant.

10. The drain stopper of claim 9, wherein the means for anchoring the open-close mechanism in the drain pipe is the male threads on the lower end of the open-close mechanism for threading into a drain pipe that has cross bars with an opening defined by female threads.

11. The drain stopper of claim 9, wherein the means for anchoring the open-close mechanism in the drain pipe is an anchor comprising a base and a set of prongs, wherein the base is in threaded engagement with the lower end of the open-close mechanism, and wherein the prongs have a catch mechanism for engaging cross bars.

12. The drain stopper of claim 9, wherein the means for anchoring the open-close mechanism in the drain pipe is a circular body having a seal around its perimeter, wherein the body is in threaded engagement with the lower end of the open-close mechanism, wherein the body has openings for allowing water to pass through the body, and wherein the body and the seal are designed and sized for a friction engagement in the drain pipe.

13. The drain stopper of claim 9, wherein the means for anchoring the open-close mechanism in the drain pipe is a rod having opposing ends and male threads, wherein one end of the rod is engaged with the female threads on the lower end of the open-close mechanism, and wherein the other end of the rod is sized to engage a threaded opening in a crossbar in the drain pipe for anchoring the drain stopper in the drain pipe.

14. The drain stopper of claim 9, further comprising a strainer basket surrounding the open-close mechanism.

15. The drain stopper of claim 14, wherein the strainer basket has a base with a central opening for receiving the open-close mechanism, an opposing end that is open and a side wall attached to the base that flares outwardly from the base, wherein the side wall has V-shaped notches adjacent to the open end, and wherein the sidewall and the base have openings for water to flow through.

16. A drain stopper kit for a bathtub having a drain opening and a drain pipe having a drain flange attached to the bathtub at the drain opening, the kit comprising: a drain stopper and means for anchoring the drain stopper in the drain pipe, wherein the means for anchoring is not made integral with the drain stopper, wherein the drain stopper comprises:

an open-close mechanism having upper and lower ends, wherein the open-close mechanism is a push mechanism, a lift-and-lock mechanism or a lift-and-turn mechanism, wherein the upper and lower ends have male threads, wherein the lower end has a bore defined by female threads, and wherein the male threads surround the female threads on the lower end;

a cap in a threaded engagement with the upper end of the open-close mechanism, wherein the drain stopper has a length between the cap and the lower end of the open-close mechanism that can be adjusted using the threaded engagement between the cap and the upper end of the open-close mechanism;

a lock nut threaded onto the upper end of the open-close mechanism and tightened against the cap for fixing the length between the cap and the lower end of the open-close mechanism; and a seal engaged with the cap for providing a seal with the drain flange or the drain pipe, wherein the means for anchoring the drain stopper in the drain pipe is in a threaded engagement with the lower end of the open-close mechanism.

17. The drain stopper kit of claim 16, wherein the kit includes at least two means for anchoring the drain stopper in the drain pipe.

18. The drain stopper kit of claim 16, wherein the means for anchoring the open-close mechanism in the drain pipe is an anchor comprising a base and a set of prongs, wherein the base is in threaded engagement with the lower end of the open-close mechanism, and wherein the prongs have a catch mechanism for engaging cross bars in the drain pipe.

19. The drain stopper kit of claim 16, wherein the means for anchoring the open-close mechanism in the drain pipe is a body having a seal, wherein the body has openings for allowing water to pass through the body, and wherein the body and the seal are designed and sized for a friction engagement in the drain pipe.

20. The drain stopper kit of claim 16, wherein the means for anchoring the open-close mechanism in the drain pipe is a rod having male threads engaged with the lower end of the open-close mechanism.

21. The drain stopper kit of claim 16, further comprising a strainer basket, wherein the strainer basket has a closed end with a central opening for receiving the open-close mechanism, an opposing open end and a side wall attached to the closed end that flares outwardly from the closed end, wherein the side wall has V-shaped notches adjacent to the open end, and wherein the sidewall and the closed end have openings for water to flow through.

22. The drain stopper kit of claim 16, wherein the kit includes at least two of the following three means for anchoring the drain stopper in the drain pipe:

(1) a base and a set of prongs, wherein the base is in threaded engagement with the lower end of the open-close mechanism, and wherein the prongs have a catch mechanism for engaging cross bars in the drain pipe;

(2) a body having a seal, wherein the body has openings for allowing water to pass through the body, and wherein the body and the seal are designed and sized for a friction engagement in the drain pipe; and (3) a rod having male threads engaged with the lower end of the open-close mechanism.

23. The drain stopper kit of claim 16, wherein the kit includes at least three means for anchoring the drain stopper in the drain pipe, wherein the three means for anchoring are:

(1) a base and a set of prongs, wherein the base is in threaded engagement with the lower end of the open-close mechanism, and wherein the prongs have a catch mechanism for engaging cross bars in the drain pipe;

(2) a body having a seal, wherein the body has openings for allowing water to pass through the body, and wherein the body and the seal are designed and sized for a friction engagement in the drain pipe; and (3) a rod having male threads engaged with the lower end of the open-close mechanism.

24. The drain stopper kit of claim 23, wherein the kit also includes a strainer basket, wherein the strainer basket has a closed end with a central opening for receiving the open-close mechanism, an opposing open end and a side wall attached to the closed end that flares outwardly from the closed end, and wherein the sidewall and the closed end have openings for water to flow through.

* * * * *